US005941104A

United States Patent [19]

Sadler

[11] Patent Number: 5,941,104

[45] Date of Patent: Aug. 24, 1999

[54] PADDLE LOCK

[75] Inventor: Dennis Sadler, Irmo, S.C.

[73] Assignee: Randall C. Hansen, Columbia, S.C.

[21] Appl. No.: 08/922,630

[22] Filed: Sep. 3, 1997

[51] Int. Cl.[6] ..... E05B 55/02

[52] U.S. Cl. ..... 70/208; 292/216; 292/DIG. 31

[58] Field of Search ..... 292/DIG. 27, DIG. 31, 292/216; 70/208, 472, 151, 489

[56] References Cited

U.S. PATENT DOCUMENTS

| | | | |
|---|---|---|---|
| 2,534,693 | 12/1950 | Adams | 292/DIG. 31 |
| 3,668,907 | 6/1972 | Pastva, Jr. . | |
| 3,707,862 | 1/1973 | Pastva, Jr. . | |
| 4,138,869 | 2/1979 | Pelcin . | |
| 4,312,202 | 1/1982 | Pastva, Jr. et al. . | |
| 4,320,642 | 3/1982 | Pastra, Jr. | 70/472 |
| 4,321,812 | 3/1982 | Pelcin . | |
| 4,335,595 | 6/1982 | Swan et al. . | |
| 4,841,755 | 6/1989 | Weineman | 292/DIG. 31 |
| 5,046,340 | 9/1991 | Weinerman | 292/DIG. 31 |
| 5,299,844 | 4/1994 | Gleason . | |
| 5,493,881 | 2/1996 | Harvey . | |
| 5,595,076 | 1/1997 | Weinerman | 70/208 |

*Primary Examiner*—Steven Meyers
*Assistant Examiner*—Gary Estremsky
*Attorney, Agent, or Firm*—Dority & Manning, P.A.

[57] ABSTRACT

A latch assembly includes a tray having a front side and a back side with a cavity defined in the front side of the tray. A handle member is pivotally mounted to the tray at the front side. An actuating member is pivotally mounted relative to the tray on the back side of the tray and is operably connected to pivot with the handle member. An operating member is mounted on the back side of the tray and is movable between a locked position and an operating position. In the operating position, the operating member is contactable by the actuating member upon movement of the handle member. A latching mechanism is configured on the back side of the tray. The latching mechanism latches and unlatches upon a striker element, and is actuated by the operating member in the operating position upon movement of the handle member. In its locked position, the operating member is moved to a position to be out of contact with the actuating member even the though the handle member and actuating member are still freely rotatable. The actuating member does not penetrate the front side of the tray.

27 Claims, 9 Drawing Sheets

PADDLE LOCK

BACKGROUND OF THE INVENTION

The present invention relates to a latch assembly, and more particularly to a paddle lock typically used on commercial vehicles.

Paddle locks or latch assemblies are well known in the art. An example of a typical paddle lock is shown in U.S. Pat. No. 5,299,844 to Gleason. This type of paddle lock or latch assembly has application in a number of different environments, for example on commercial vehicles, motor homes, recreational vehicles, tool boxes, etc.

Certain problems have existed with respect to these conventional paddle locks which the present invention is intended to improve upon. For example, it has been a longstanding problem in the industry that water and other debris makes its way into the latch mechanism through the housing or tray. This water and foreign matter will eventually cause damage to the latch assembly and possibly the vehicle itself. Attempts have been made in the art to correct this problem. For example, the '844 patent to Gleason provides a paddle lock wherein a rubber gasket or seal is provided in the hole through the housing or tray through which the leg portion of the paddle handle extends. It is also known to provide rubber sheets or material over the openings in the tray or housing to hopefully limit the amount of water that can seep behind the tray.

Security of the paddle locks has also been a concern. With the typical paddle lock, the lock mechanism moves a member into engagement with the actuating member of the handle so as to block movement of the handle. In other words, when the paddle lock is locked, the handle cannot be pivoted or rotated. However, with this type of arrangement, the paddle lock is only as secure as the member which prevents movement of the handle. A crow bar or other lever can be inserted under the handle and used to pry the handle open against the blocking member. Either the handle will break or the blocking member will break which then allows the paddle lock to be opened.

OBJECTS AND SUMMARY OF THE INVENTION

It is therefore a principle object of the present invention to provide an improved paddle lock or latch assembly to overcome the problems discussed above with conventional such devices.

Additional objects and advantages of the invention will be set forth in part in the following description, or may be obvious from the description, or may be learned through practice of the invention.

In accordance with the objects of the invention, the present latch assembly includes a tray having a front side and a back side. A cavity is defined in the front side of the tray by side wall members. A handle member or paddle is pivotally mounted relative to the tray at least partially within the cavity. An actuating member is pivotally mounted relative to the tray and is mounted on the outside of the cavity on the back side of the tray. The actuating member is operably connected with the handle so as to pivot therewith. An operating member is also mounted on the back side of the tray and is movable between a locked position and an operating position. In the operating position, the operating member is contacted by the actuating member upon movement of the handle. In the locked position, the operating member is moved out of contact with the actuating member.

Thus, in the locked position, the handle can still be pivoted relative to the housing, but the actuating member does not engage the operating member. A latching mechanism is also configured on the back side of the tray and may include means for latching and unlatching a striker element or other conventional latching devices. The latching mechanism is actuated by the operating member in the operating position upon movement of the handle member.

The assembly also includes a lock mechanism to move the operating member into and out of the operating position. To lock the latch assembly, an operator turns the lock mechanism, which has an arm on the back side of the tray contacting the operating member, to move the operating member to the locked position out of contact with the actuating member.

The paddle or handle member is pivotally mounted relative to the tray by an axle that extends between the side wall members. A portion of the axle extends through at least one of the side wall members and the actuating member is attached on this portion of the axle. Thus, it is not necessary to penetrate the front side of the tray or provide any sort of opening or access for an arm or leg of the handle. Since the holes for the axle extend through vertical side walls of the tray, there is very little chance that water will seep behind the tray.

The latching mechanism according to the invention may comprise a conventional rotary lock mechanism. Such mechanisms are well known by those skilled in the art and generally include rotary cam elements wherein at least one of the cam elements rotates and latches onto a striker element. However, it should be understood, that various other types of latching mechanisms, including remote cable or rod actuated devices, can also be used in the present invention and that the invention is not limited to a rotary cam type of mechanism.

DETAILED DESCRIPTION OF THE PREFERRED EMBODIMENTS

Reference will now be made in detail to the presently preferred embodiments of the invention, one or more examples of which are illustrated in the accompanying drawings. Each example is provide by way of explanation of the invention, and not meant as a limitation of the invention. In fact, it will be apparent to those skilled in the art that various modifications and variations can be made in the present invention without departing from the scope or spirit of the invention. For examples, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
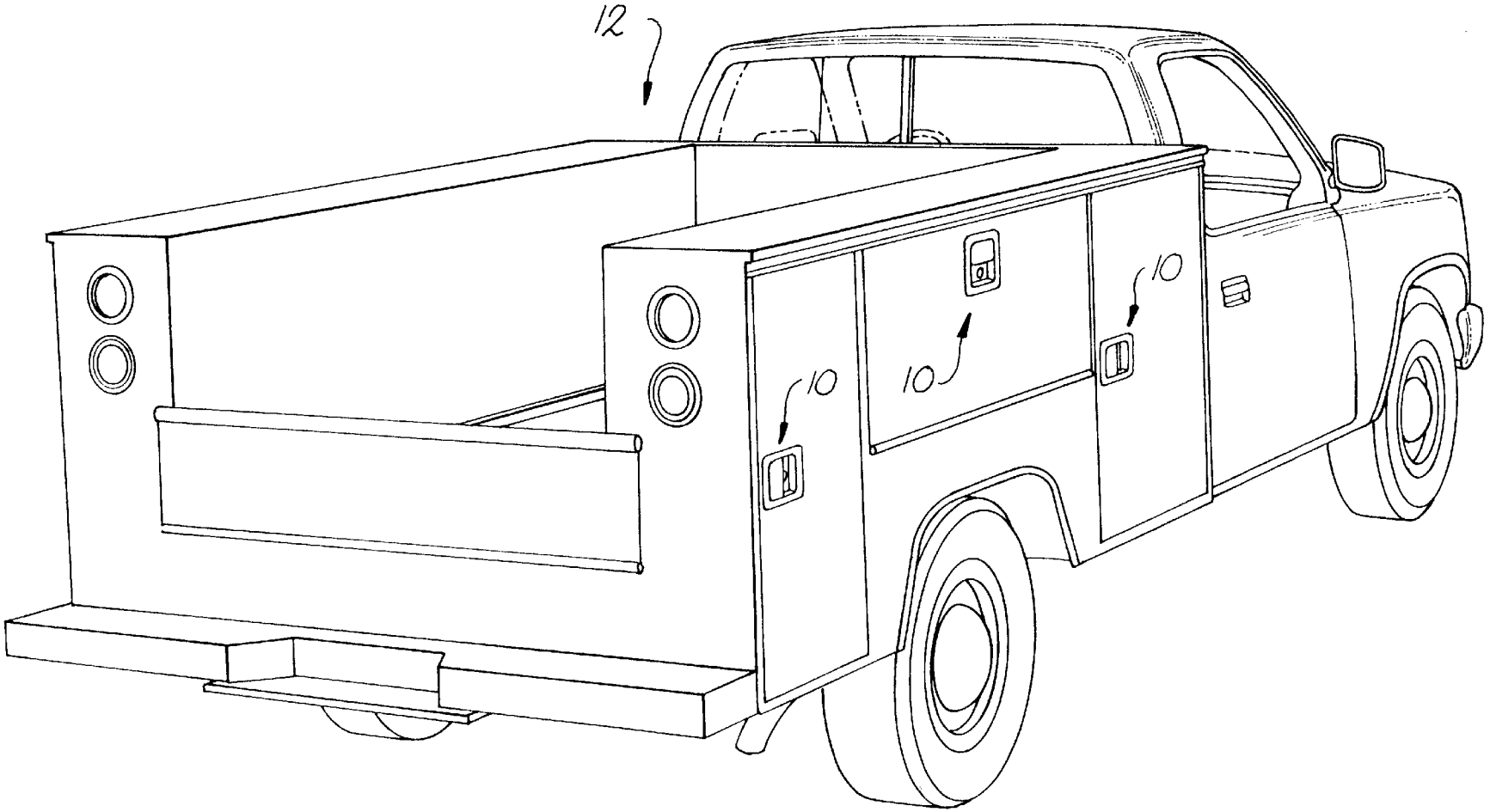
FIG. 1 is a perspective view of the present invention utilized as a latching mechanism for panels of a utility truck.

The latch assembly according to the invention is illustrated in the figures generally as element 10. FIG. 1 illustrates latch assembly 10 in one operational environment as a latch or lock element for panel doors of a utility truck. FIG. 1 is only meant to illustrate one environment of the invention. It should be understood that the latch assembly according to the invention can be used in any number of environments, including recreational vehicles, any manner of commercial vehicles, marine applications, etc.

Referring to the figures in general, latch assembly 10 includes a housing or tray, generally 14. Tray 14 has a front side 16 and a back side 18. Tray 14 can also serve as part of the means for mounting the latch assembly on a vehicle and, in this regard, may contain a flange 30 around the circumference thereof. Flange 30 would circumscribe an opening defined in the panel or door in which the latch assembly is mounted, as particularly seen in FIG. 1. In this regard, a mounting bracket 44 may also be mounted to the tray, for instance by bolts 50, 36, or any other conventional attaching means. The mounting bracket 44 includes side walls 46 and a back surface 48. Spacers 49 are disposed between back surface 48 and back side 18 of tray 14. To mount assembly 10, the back side of the tray is placed through an opening so that the back side of flange 30 lies against the door or panel. Mounting bracket 44 is tightened from back side 18 and essentially sandwiches the door member or panel between the mounting bracket and flange.

It should, however, be understood that the mounting bracket is not a critical feature of the invention, and is merely provided as one means for mounting the latch assembly. Any manner of conventional devices may be used to mount the latch assembly. For example, an adhesive may be applied to the back side of flange 30 wherein the flange is merely pressed and adhered against the door panel. Alternately, screws could attach the assembly through flange 30 directly into the door panel. Any manner of conventional mounting devices and means can be used in this regard.

Figure 2:
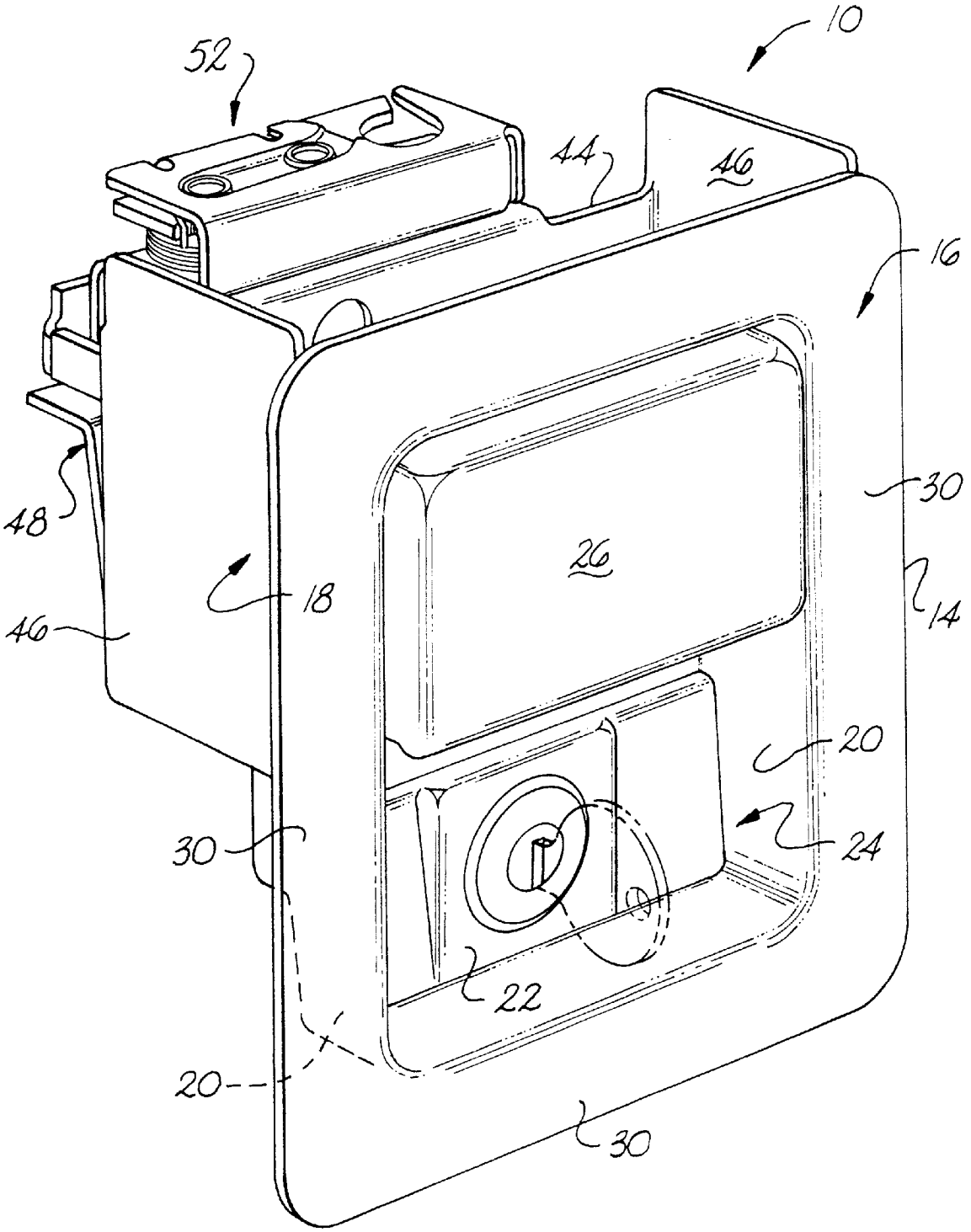
FIG. 2 is a perspective view of the latch assembly according to the invention.

Assembly 10 also includes a handle member, generally 26. Handle 26 is preferably formed as a paddle handle, as commonly understood by those in the art. However, handle 26 can have any desired configuration. Handle 26 is pivotally mounted on front side 18 of tray 14 so that it can be pulled outward, as particularly seen in FIGS. 3*a* and 5*a*. In a preferred embodiment, handle 26 is pivotally mounted by way of an axle 74 mounted relative to tray 14. In this embodiment, tray 14 includes side wall members 20 which define a cavity 24 in the front side 16 of tray 14. Handle 26 is housed at least partially within cavity 24 so that the front surface of handle 26 is flush with or extends barely outward beyond front side 16 of tray 14, as particularly seen in FIGS. 2 and 5. Axle 74 is mounted between oppositely facing side walls 20, as particularly seen in FIGS. 3 through 6. At least one of the side walls 20 is penetrated by an extending portion 76 of axle 14. The other end of the axle may be mounted within cavity 24, or may also extend through the opposite side wall 20. As particularly seen in FIG. 3, in the embodiment wherein a mounting bracket 44 is used, the portion 76 of axle 74 extending through the tray side wall is located in a space between bracket 44 and side wall 20. A lock washer 77 is placed on the opposite end of axle 74 to maintain the axle in position.

Figure 4:
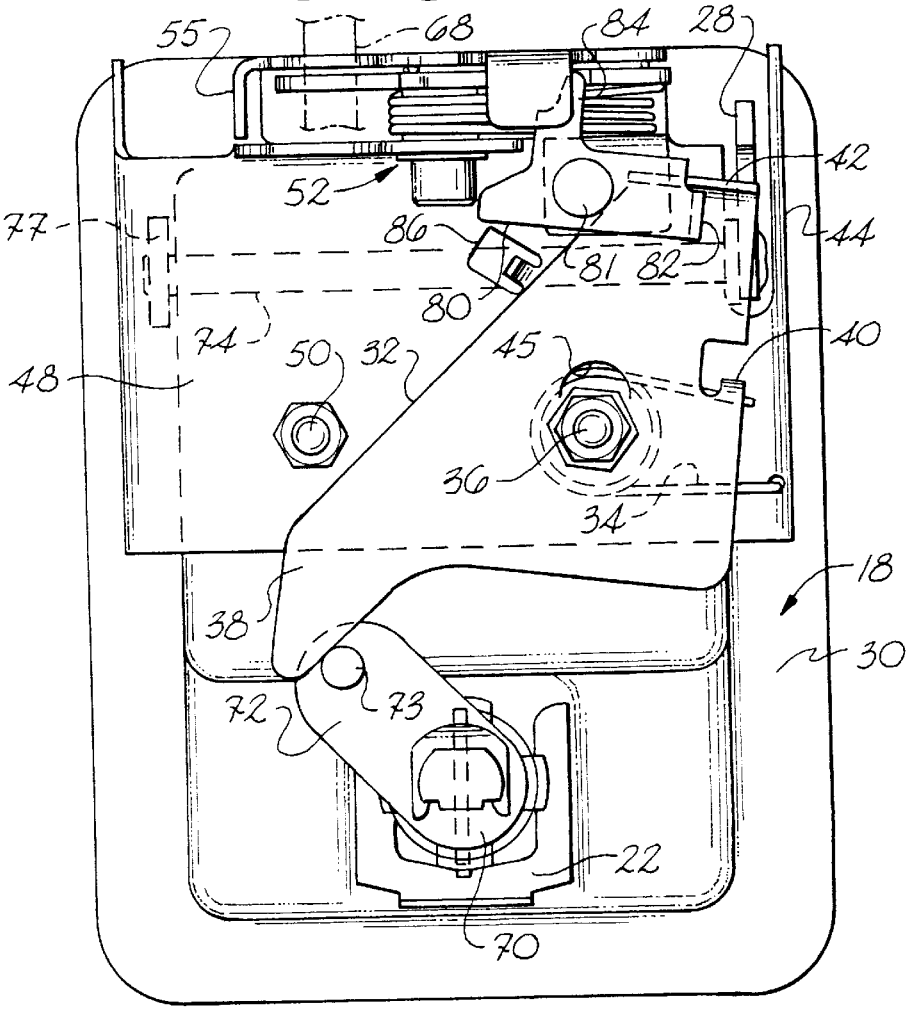
FIG. 4 is a back view of the latch assembly particularly illustrating the operating member moved to its operating position with the latching mechanism engaged on the striker.
Figure 5:
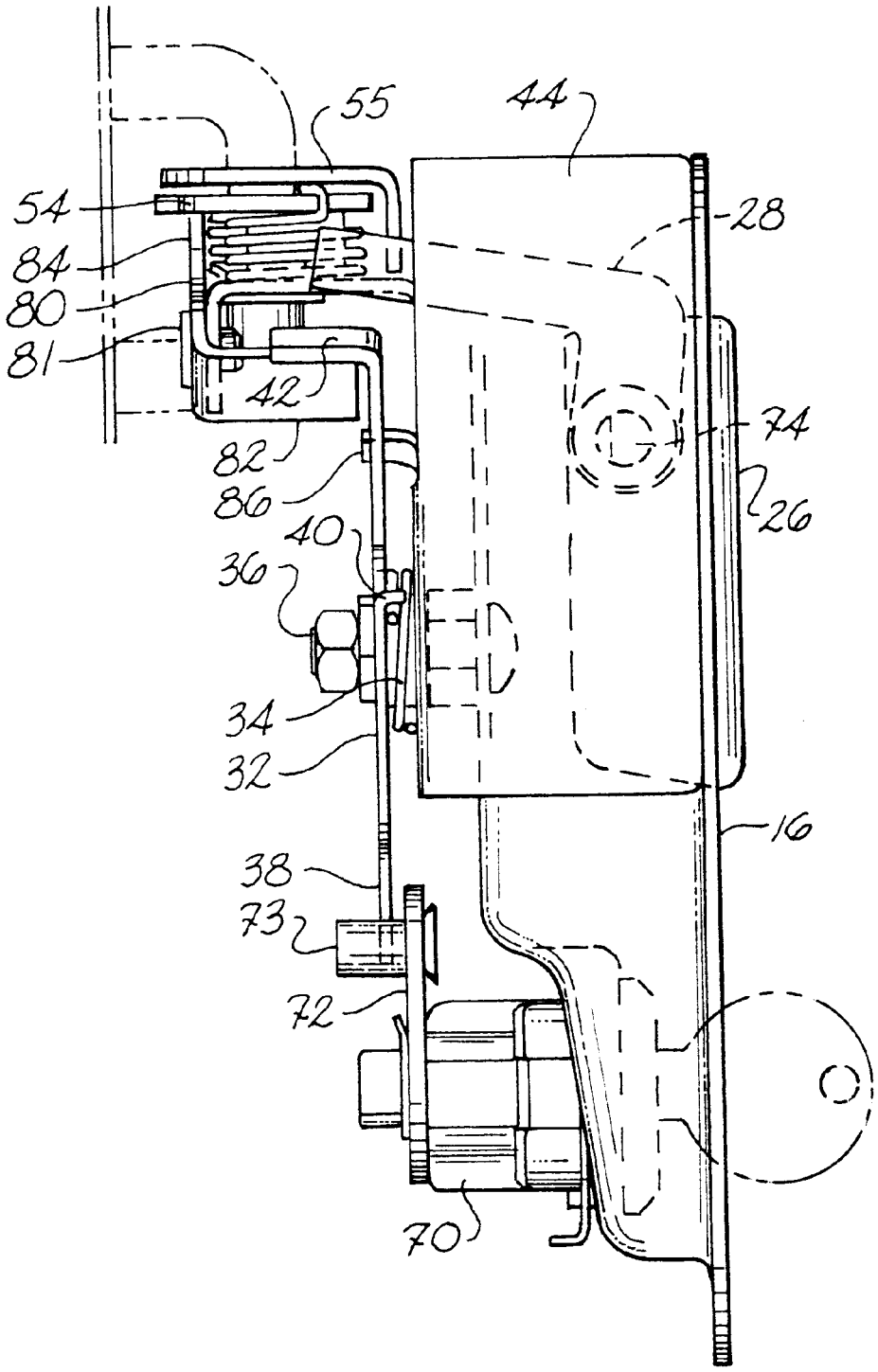
FIG. 5 is a side view of the latch assembly.
Figure 5A:
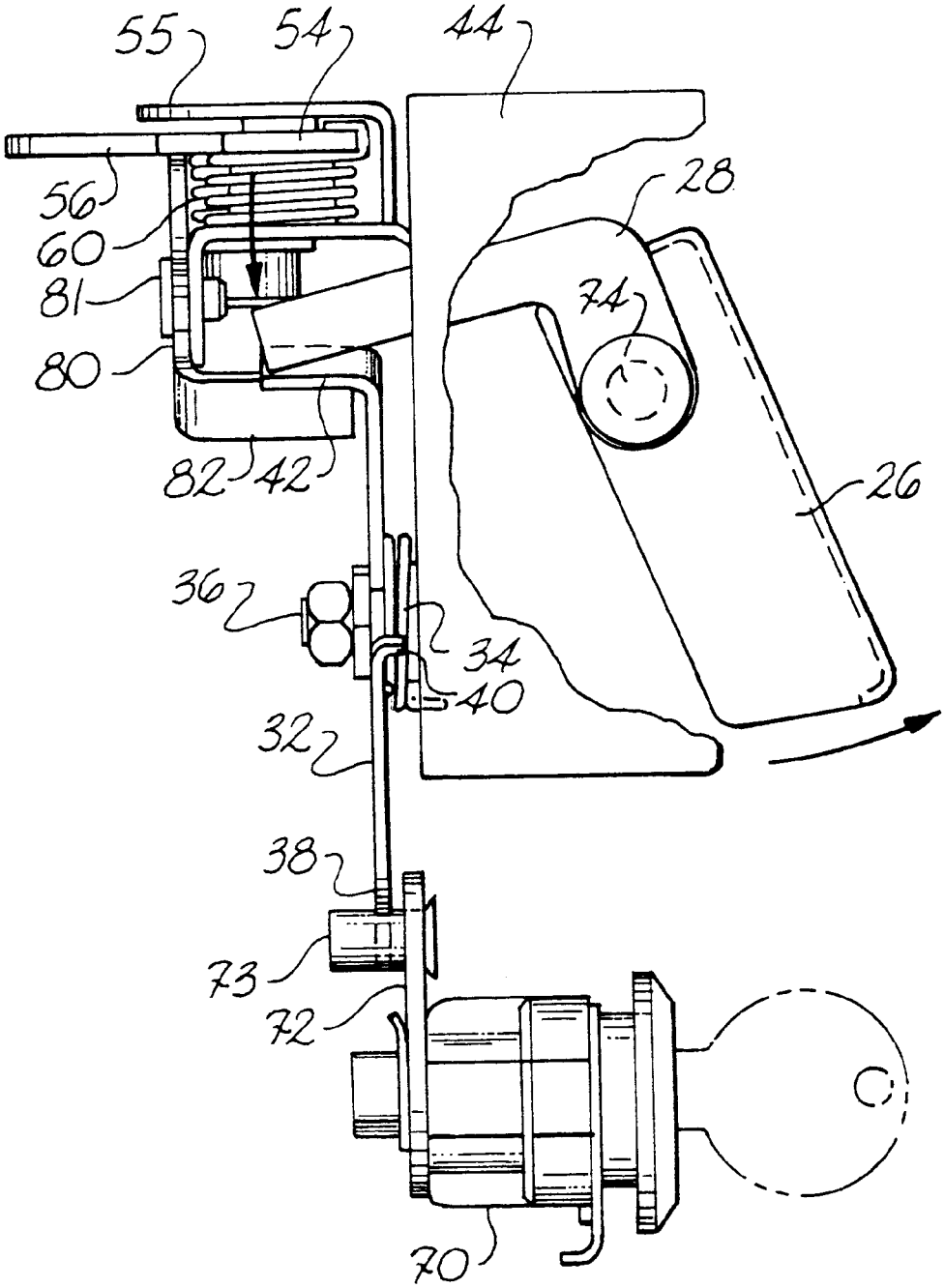
FIG. 5*a* is an operational side view of the latch assembly particularly illustrating the handle 26 being rotated outward with the actuating member engaging the operating member.
Figure 6:
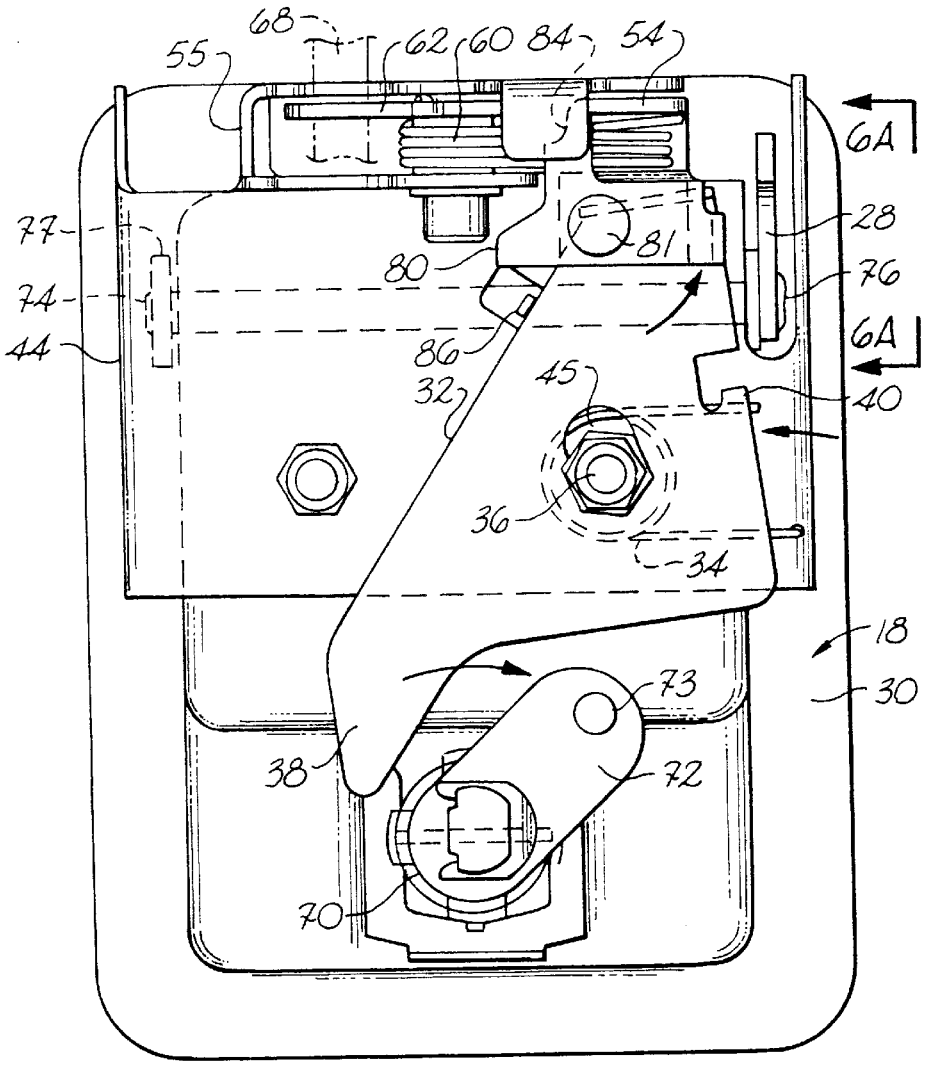
FIG. 6 is a back view of the latch assembly illustrating the device in the locked position wherein the operating member is moved into a position out of contact with the actuating member.

Referring particularly to FIGS. 4 through 6, an actuating member 28 is operably connected to handle member 26 to pivot therewith. This operation is particularly illustrated in FIG. 5*a*. Actuating member 28 is mounted on back side 18 of tray 14 and does not extend through any sort of opening in tray 14. In the embodiment illustrated, actuating member 28 comprises an L-shaped member and is fixed on the portion 76 of axle 74 extending through side wall 20 of tray 14. Thus, actuating member 28 is rotatable with handle 26 to actuate the mechanism on the back side 18 of tray 14 without the necessity of defining a hole or opening through the tray for the actuating member.

Actuating member 28 engages an operating member 32 mounted for pivotal or rotational movement on back side 18 of tray 14. In the embodiment illustrated, operating member 32 is mounted to rotate about bolt 36. Bolt 36 can also be used to mount mounting bracket 44, as discussed above. Operating member 32 has an oval slot 45 defined therein which allows for operating member 32 to have rotational movement as well as a degree of longitudinal displacement, as discussed in more detail below. Operating member 32 has a leg member 38 at one end and an extending member 42 at the other end which is engaged by actuating member 28. Operating member 32 is movable between a locked position illustrated in FIG. 6, and an operating position illustrated in FIGS. 4 and 4*a*. Operating member 32 is spring loaded by way of spring 34 to the locked position illustrated in FIG. 6. Spring 34 is attached at one end to mounting bracket 44 and to operating member 32 by way of a retaining tab 40, as particularly seen in FIGS. 4 and 6.

Figure 6A:
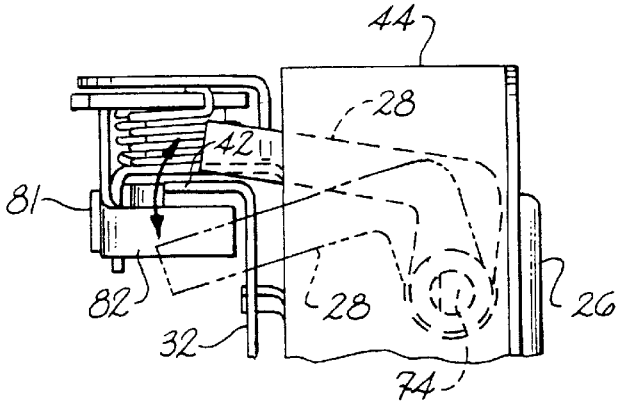
FIG. 6*a* is a side view of the latch assembly particularly illustrating movement of the actuating member.

In the locked position illustrated in FIG. 6, operating member 32 is rotated and maintained in position by spring 34 at a location such that actuating member 28 does not engage operating member 32 when the handle 26 is pulled outward. In other words, referring particularly to FIG. 6*a*, with operating member 32 in its locked position, handle 26 can be freely rotated and actuating member 28 also freely pivots or rotates but does not engage any mechanism on the back side of the assembly. Thus, the integrity or security of assembly 10 does not depend on a device or member that blocks movement of handle 26. Even if a vandal were to insert a crow bar or lever under handle 26 and force it outward, either handle 26 or actuating member 28 would break, but the latch mechanism would not be disengaged and would remain locked.

The locked position of operating member 32 is defined by a stop 86 which limits the degree of movement of operating member 32.

Figure 3:
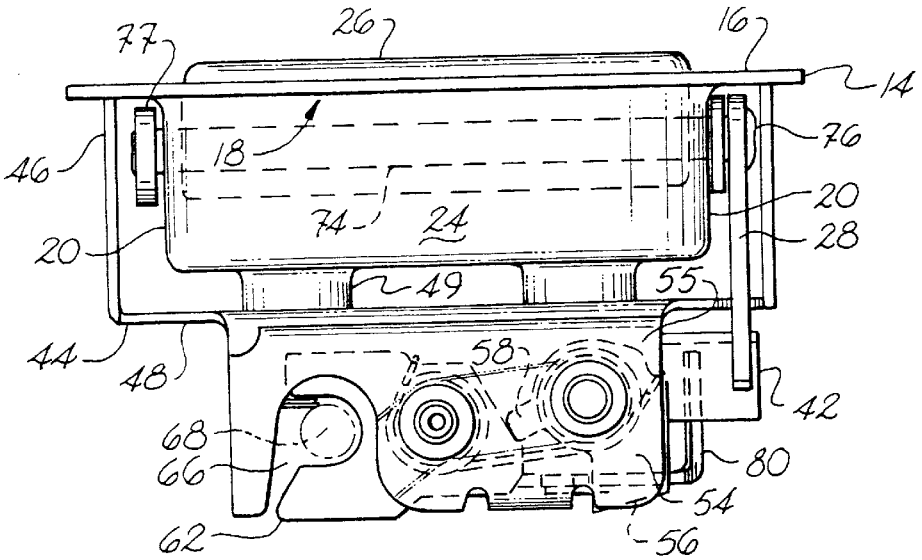
FIG. 3 is a top view of the latch assembly shown in its latched position relative to the striker element.
Figure 3A:
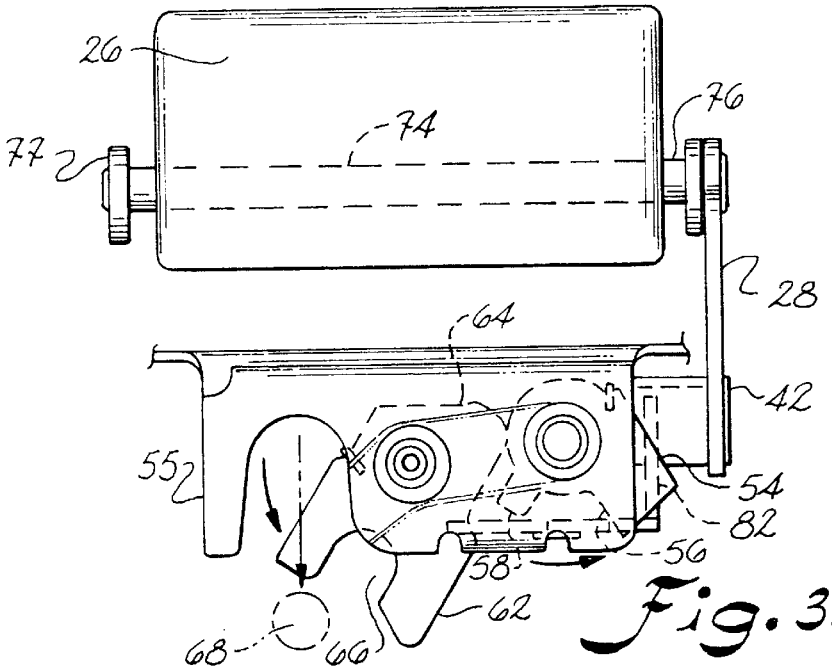
FIG. 3*a* is a top view of relevant portions of the latch assembly particularly illustrating the handle being rotated to open the latch assembly causing the latching mechanism to release from the striker element.
Figure 4A:
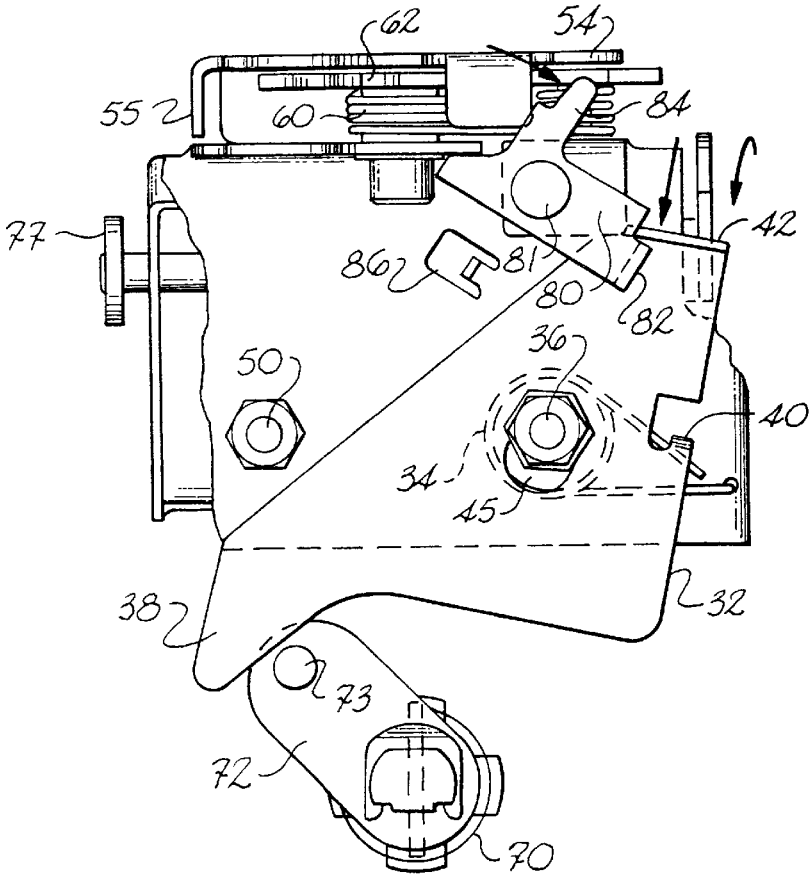
FIG. 4*a* is a back view of the latch assembly illustrating the operating member being moved by the actuating member and causing the latching mechanism to release from the striker element, as shown in FIG. 3*a;*

In order to unlock the assembly, an operator would turn the key of lock mechanism 70. The key access is disposed on a key bed 22 defined on front side 16 of tray 14, as particularly seen in FIG. 2. When the key rotates, a leg member 72 of the lock mechanism also rotates. A pin 73 extends from leg member 72. When the leg rotates to the counterclockwise position, as seen in FIGS. 4 and 4*a*, pin 73 engages leg 38 of operating member 32 and forces operating member 32 to rotate clockwise to the position shown in FIG. 4. Once the operating member is moved to this position, the handle can then be pulled to disengage the latching mechanism 52 from a striker 68, as commonly understood in the art. Thus, it should be understood, that FIG. 3 illustrates the latch assembly as if the door panel is shut and latching mechanism 52 is engaged on a striker 68. So long as operating member 32 is maintained in its locked position illustrated in FIG. 6, movement of handle 26 will not cause the device to disengage from striker 68. Once operating member 32 is moved to its operating position illustrated in FIG. 4, by movement of lock mechanism 70, subsequent movement of handle 26 will then cause the mechanism to disengage from striker 68, as particularly seen in FIGS. 3*a* and 4*a*. When handle 26 is pulled outward, the L-shaped actuating member 28 engages extending member 42 of operating member 32 and causes operating member 32 to rotate in the clockwise position and to be displaced longitudinally downward, as particularly seen in FIG. 4*a*.

An intermediate member 80 is also rotationally mounted and operatively connects operating member 32 to latching mechanism 52, as particularly seen in FIG. 4*a*. Intermediate member 80 is mounted for rotation about a pin 81 and has a first leg member 82 extending towards operating member 32. When operating member 32 rotates clockwise, extending member 42 contacts leg 82 and causes the intermediate member to also rotate in the same direction. Intermediate member 80 includes a second leg 84 that engages a cam in the latching mechanism 52 causing the latching mechanism to then disengage from the striker element 68. The operation of the latching mechanism will be explained in more detail below.

The movement of the various members can be described in relation to planes of movement. For example, actuating member 28 pivots in a first plane that is essentially perpendicular to the axis of axle 74. The operating member pivots in a second plane that is essentially parallel to the axis of axle 74 and perpendicular to the rotational plane of actuating member 28. Intermediate member 80 pivots in a plane parallel to the plane of movement of operating member 32. Cams 54, 62 of latching mechanism 52 rotate in a plane parallel to the axis of axle 74 but perpendicular to the plane of movement of actuating member 28. It should be appreciated by those skilled in the art that any manner or combination of movable elements and planes of movement can be configured to transfer movement of handle 26 to a latching mechanism to cause the latching mechanism to release from a striker element. All such modifications and variations of connecting or operating members is within the scope and spirit of the invention.

In the preferred embodiment illustrated, the latching mechanism 52 is illustrated as a conventional rotary latching mechanism that includes a first cam element 54 and a second cam element 62. Such devices are well understood by those skilled in the art and a detailed explanation thereof is not necessary for purposes of the present invention. For example, a conventional rotary lock mechanism is illustrated in U.S. Pat. No. 5,299,844 to Gleason discussed in the background section of the application. Hansen Manufacturing Company and Versch Lock Manufacturing Company of Columbia, South Carolina, also manufactures and sells a line of rotary locks that can be incorporated as the latching mechanism in the present assembly. Likewise, Eberhard Company of Cleveland, Ohio, also manufactures a rotary lock suitable for use as the latching mechanism.

In general, latching mechanism 52 includes a first cam member 54 mounted for rotational movement in a housing 55. Cam 54 includes a first leg 56 and a tab 58, as generally seen in FIG. 3*a*. Leg 56 is engaged by tab 84 of intermediate member 80. As first cam 54 is engaged by the intermediate member and rotated, tab 58 engages a second cam element 62. Second cam element 62 includes a leg portion 64 engaged by tab 58 and defines a recess 66 that engages a fixed striker 68. Movement of first cam 54 causes second cam 62 to rotate counterclockwise, as seen in FIG. 3*a*, and causes second cam 62 to release from and force the striker element 68 out of housing 55. A spring 60 is configured with both cam elements and spring biases the second cam element 62 to the release position shown in FIG. 3*a*. Thus, when operating member 32 is in its operating position shown in FIG. 4 and an operator pulls handle 26 outward, as shown in FIG. 3*a*, second cam element 62 forcefully ejects striker 68 causing the latch assembly 10 (and door) to move away from the striker element. Once released from the striker element 68, the latch assembly remains in the position illustrated in FIG. 3*a* until the door is shut again. When the door is shut, second cam 62 will engage the striker 68 as the door moves inward and cam 62 will rotate clockwise to lock onto the cam element, as particularly seen in FIG. 3. Second cam 62 stays in the locked position due to engagement of tab 58 against the cam. Second cam 62 will not release again until the first cam 54 is rotated so that tab 58 no longer locks the second cam in position.

It should be understood that the latching mechanism described and illustrated in this application is but one preferred embodiment of any number of suitable latching mechanisms. It is well within the level of skill of those in this art to configure any number of conventional latching mechanisms for use in the present invention. For example, the latching mechanism may include remote members located at various positions on the vehicle panel or frame which are actuated by rods or cables, as illustrated generally in FIG. 7. Such devices are well known by those skilled in the art.

Figure 7:
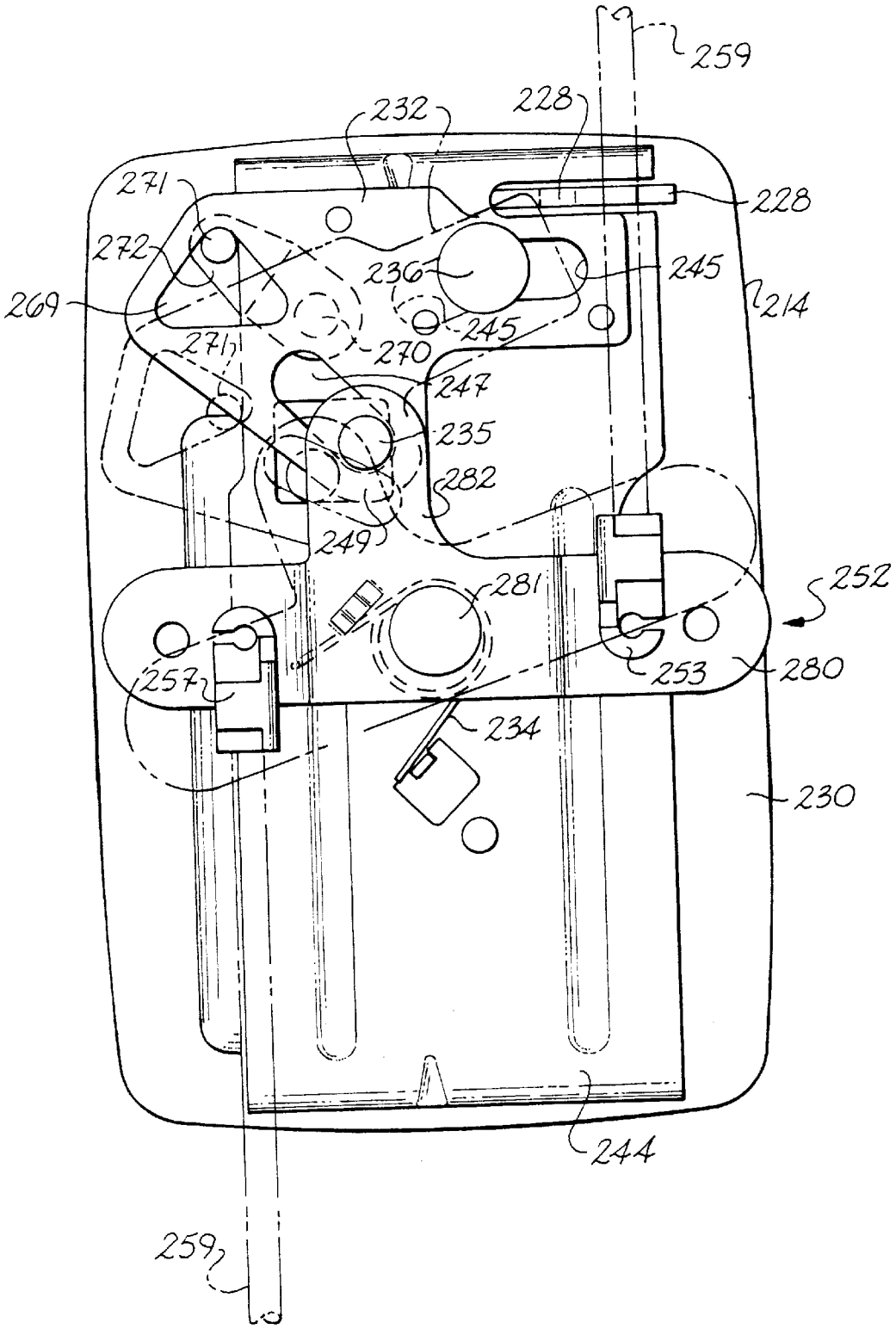
FIG. 7 is a back side operational view of another embodiment of the present invention.

FIG. 7 illustrates another embodiment of the invention. Many features of this embodiment are similar to those discussed above and will not be described here in great detail. This embodiment includes a tray 214 having a flange 230. A mounting bracket 244 is also provided. According to this embodiment, the actuating member 228 is pivoted by movement of a handle on the front side of the device (not shown). The operating member 232 is movable between a locked position illustrated in solid lines in the figure, and an operating position illustrated in dashed lines wherein operating member 232 is engaged by pivoting movement of actuating member 228.

Operating member 232 is moved between the locked and operating position by a lock mechanism 270 which is turned by a key on the front side of the device. Lock mechanism 270 includes a rotatable leg member 272 with an extending pin 271. Pin 271 moves within a triangular shaped space defined in operating member 232. In the locked position illustrated in dashed lines, pin 271 resides in the uppermost apex of the triangular shaped recess 269. An operator turns lock mechanism 270 so that pin 271 and leg 272 essentially rotate counterclockwise, as shown in the dashed lines. This counterclockwise movement of the locked mechanism causes the operating member to also rotate in a counterclockwise direction about bolt or pin 236. This movement of operating member 232 causes a leg of operating member 232 to move into the path of travel of actuating member 228, as shown in the dashed line representation.

Once operating member 232 is moved into its operating position, movement of the handle on the front side (not shown) causes actuating member 228 to engage the leg of operating member 232. Operating member 232 is then driven in a longitudinal direction defined by oblong hole 245. The dashed line representation shown in FIG. 7 illustrates the device when the handle on the front side has been pulled outward and actuating member 228 has fully engaged operating member 232. The illustration shows operating member 232 at its fullest extent of longitudinal travel defined by oblong hole 245.

In this embodiment, intermediate member 280 comprises a member extending across mounting bracket 244 and rotatably mounted by pin or bolt 281. Intermediate member 280 includes an upwardly extending leg member 282 that includes a pin 235. Pin 235 engages in a second oblong hole 247 defined in operating member 232. Pin 235 engages through the oblong hole 247 and into a generally rectangular or square shaped space defined in mounting bracket 244. In the locked position of operating member 232, pin 281 resides in one end of oblong hole 247, as shown by the solid line representation. In the operating position when operating member 232 rotates counterclockwise, pin 281 engages in the other end of oblong hole 247. In this position, when operating member 232 is then moved in the longitudinal direction by movement of actuating member 238, the intermediate member 280 is also caused to rotate counterclockwise about point or bolt 281. Intermediate member 280 is spring loaded against motion in the counterclockwise direction by spring 234.

The assembly illustrated in FIG. 7 is particularly useful for actuating remotely located release or lock devices. In this embodiment, cables or rods 259 are attached to intermediate member 280 by any conventional means, including simple plastic retaining devices 257. Thus, when intermediate member 280 rotates counterclockwise as illustrated in the figure, the rods or cables 259 are moved in the longitudinal direction and will cause remotely disposed locking or release devices to release from a remote striker element. Depending on the operational disposition of the remote element, the cables or rods 259 can be positioned to move away from the tray 214, as illustrated in FIG. 7, or to move towards the tray 214. The operation of such remotely disposed release or locking devices actuated by cable or rod drives members 259 is well understood by those skilled in the art and a detailed explanation thereof is not necessary for purposes of the present description.

Figure 8:
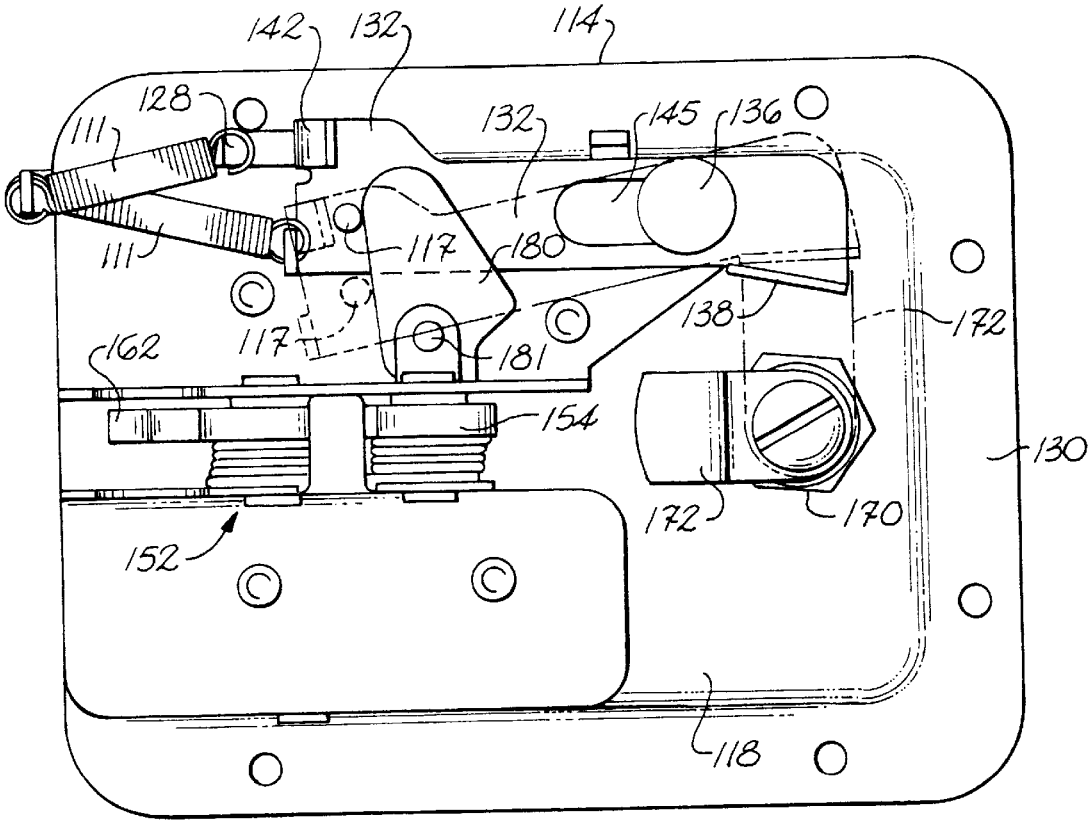
FIG. 8 is a back side operational view of yet another embodiment of the invention.

Another preferred embodiment of the invention is illustrated in FIG. 8. In this embodiment, tray 114 includes a flange 130 for mounting onto a vehicle panel or door. This embodiment does not include a mounting bracket. However, it should be understood that a bracket could be included. This embodiment includes a latching mechanism 52 utilizing first and second cam elements 154, 162. The operation of such devices is well understood by those skilled in the art and is explained above.

In this embodiment, actuating member 128 is rotatably mounted to the backside of tray 114 and does not extend through the tray. Actuating member 128 is caused to pivot by movement of a handle on the front side (not shown), as described above. In this embodiment, operating member 132 comprises a longitudinally extending member having an oblong hole 145 defined therein. In the operating position of operating member 132 illustrated in solid lines in the figure, an extending member 142 is disposed in the plane of travel of actuating member 128. Thus, when actuating member 128 is caused to rotate by movement of the handle, it engages extending member 142 and causes operating member 132 to move in the longitudinal direction as defined by oblong hole 145. Intermediate member 180 is rotatably mounted by way of pin or bolt 181. Intermediate member 180 is engaged by an extending pin 117 on operating member 132 as the operating member moves in the longitudinal direction relative to oblong hole 145. Engagement by pin 117 causes intermediate member 180 to rotate in the clockwise direction as seen in the figure. This clockwise movement of intermediate member actuates the rotary cam mechanism, as described above.

This embodiment also includes a lock mechanism 170 having an extending leg 172. Lock mechanism 170 is actuated on the front side by an operator turning a key. When the lock mechanism is turned in the clockwise direction as seen in the figure, leg 172 engages an extending leg member 138 of operating member 132 and causes the operating member to rotate in the counterclockwise direction about pin or bolt 136, as seen in the dashed representation shown in FIG. 8. This counterclockwise movement of operating member 132 causes member 142 to be moved out of the plane of travel of actuating member 28. Thus, the device cannot be opened or actuated by movement of the handle and actuating member 128 when operating member 132 is in the locked position illustrated by the dashed representation. Both the actuating member 128 and operating member 132 are spring biased by springs 111. Operating member 132 is spring biased towards actuating member 128. Actuating member 128 is spring biased away from operating member 132.

It should be understood by those skilled in the art that the various components of the various embodiments described above can be interchanged with each other to provide yet further embodiments of the invention. It should be appreciated by those skilled in the art that these and other various modifications and variations can be made in the present invention without departing from the scope or spirit of the invention. It is intended that the present application cover such modifications and variations as come within the scope of the appended claims and their equivalents.

What is claimed is:

1. A latch assembly, comprising:

a tray having a front side and a back side;

a handle member pivotally mounted to said tray;

an actuating member mounted to said handle member to pivot therewith relative to said tray;

an operating member defining a slot therethrough and being pivotally and slidably mounted on said back side of said tray via a mounting element fixed to said tray and extending through said slot, said operating member being pivotally movable relative to said tray between a locked position and an operating position, in said operating position, said operating member being contactable by said actuating member upon movement of said handle member to slide said operating member relative to said tray; and a latching mechanism configured on said back side of said tray, said latching mechanism including means for latching and unlatching said latch assembly, said latching mechanism actuated by sliding of said operating member from said operating position upon movement of said handle member and said actuating member.

2. The latch assembly as in claim 1, wherein in said locked position of said operating member, said actuating member does not contact said operating member upon movement of said handle member.

3. The latch assembly as in claim 1, further comprising a lock mechanism configured to move said operating member between said locked position and said operating position.

4. The latch assembly as in claim 3, wherein in said locked position, said lock mechanism moves said operating member out of contact with said actuating member.

5. The latch assembly as in claim 1, wherein said front side of tray includes a cavity defined by side walls said locking assembly further comprising an axle mounted relative to said front side of said tray with a portion thereof extending through at least one of said side walls, said actuating member disposed on said axle portion extending through said side wall.

6. The latch assembly as in claim 5, wherein said actuating member pivots in a first plane essentially perpendicular to said axle, and said operating member pivots in a second plane essentially parallel to said axle.

7. The latch assembly as in claim 6, wherein said latching mechanism comprises at least one cam element operably connected with said operating mechanism, said cam element pivoting in a third plane essentially perpendicular to said second plane.

8. The latch assembly as in claim 7, wherein said latching mechanism comprises a second cam element actuated by said first cam element, said second cam element lockable onto and releasable from a striker element.

9. The latch assembly as in claim 1, further comprising a mounting bracket attached to said back side of said tray, said operating member pivotally mounted to said mounting bracket, said latching mechanism operably mounted on said mounting bracket.

10. The latch assembly as in claim 1, wherein said handle member comprises a paddle handle.

11. The latch assembly as in claim 1, further comprising a spring member urging said operating member toward said locked position.

12. The latch assembly as in claim 1, wherein said latching mechanism comprises drive members movable by said operating member for actuating remotely disposed locking members.

13. The latch assembly as in claim 1, wherein in said locked position of said operating member, said actuating member and said handle member are freely pivotable relative to said tray and said operating member is spaced from said actuating member so as not to have contact therewith.

14. The latch assembly as in claim 1, wherein said latching mechanism comprises a rotary latching device.

15. The latch assembly as in claim 1, wherein said latching mechanism comprises a remotely disposed locking device, and drive members moved by said operating member to actuate said remotely disposed locking device.

16. The latch assembly as in claim 1, further comprising a spring member urging said operating member toward said operating position.

17. The latch assembly as in claim 1, further comprising an intermediate member pivotally mounted to said tray and operatively connecting said operating member and said latching mechanism, and actuated by sliding of said operating member from said operating position upon movement of said handle member and said actuating member to thereby actuate said latching mechanism.

18. The latch assembly as in claim 17, further comprising a spring member urging said intermediate member in a direction opposite of the direction in which said intermediate member pivots to actuate said latching mechanism.

19. The latch assembly as in claim 3, wherein in said locked position of said operating member, said lock mechanism contacts said operating member.

20. The latch assembly as in claim 3, wherein in said locked position of said operating member, said lock mechanism avoids contact with said operating member.

21. A latch assembly, comprising:

a tray having a front side and a back side;

a handle member pivotally mounted to said tray;

an actuating member mounted to said handle member to pivot therewith relative to said tray;

an operating member defining a slot therethrough and being pivotally and slidably mounted on said back side of said tray via a mounting element fixed to said tray and extending through said slot, said operating member being pivotally movable relative to said tray between a locked position and an operating position, in said operating position, said operating member being contactable by said actuating member upon movement of said handle member to slide said operating member relative to said tray;

an intermediate member pivotally mounted to said tray and pivotally actuated by said operating member sliding relative to said tray upon movement of said handle member;

a latching mechanism configured on said back side of said tray, said latching mechanism including means for latching and unlatching said latch assembly, said latching mechanism actuated by pivoting of said intermediate member upon movement of said handle member; and a lock mechanism configured to pivot said operating member between said locked position and said operating position.

22. The latch assembly as in claim 21, further comprising a spring urging said operating member toward said locked position.

23. The latch assembly as in claim 21, further comprising a spring member urging said operating member toward said operating position.

24. The latch assembly as in claim 21, further comprising a spring member urging said intermediate member in a direction opposite of the direction in which said intermediate member pivots to actuate said latching mechanism.

25. The latch assembly as in claim 21, wherein in said locked position of said operating member, said lock mechanism contacts said operating member.

26. The latch assembly as in claim 21, wherein in said locked position of said operating member, said lock mechanism avoids contact with said operating member.

27. The latch assembly as in claim 21, wherein in said locked position of said operating member, said actuating member does not contact said operating member upon movement of said handle member.

* * * * *